United States Patent [19]

Bischofberger et al.

[11] 4,432,200

[45] Feb. 21, 1984

[54] METHOD FOR THE SUCTION REMOVAL OF THREAD BREAKS AND THREAD SUCTION APPARATUS

[75] Inventors: Jürg Bischofberger, Heftenbach; Herbert Stalder, Kollbrunn, both of Switzerland

[73] Assignee: Rieter Machine Works Limited, Winterthur, Switzerland

[21] Appl. No.: 392,625

[22] Filed: Jun. 28, 1982

[30] Foreign Application Priority Data

Jul. 17, 1981 [CH] Switzerland ..... 4705/81

[51] Int. Cl.[3] ..... D01H 11/00

[52] U.S. Cl. ..... 57/304

[58] Field of Search ..... 57/300, 304, 306, 1, 57/308; 15/301

[56] References Cited

U.S. PATENT DOCUMENTS

| | | | |
|---|---|---|---|
| 908,341 | 12/1908 | Shipp | 57/304 X |
| 2,901,881 | 9/1959 | Byrum | 15/301 X |
| 2,946,174 | 7/1960 | Bahnson | 57/306 X |
| 2,977,181 | 3/1961 | Reiterer | 57/304 |
| 3,018,503 | 1/1962 | Hijiya et al. | 57/304 X |
| 4,255,925 | 3/1981 | Marzolli | 57/304 |

*Primary Examiner*—Donald Watkins

*Attorney, Agent, or Firm*—Werner W. Kleeman

[57] ABSTRACT

To ensure for the effective removal by suction of thread breaks, even at long ring spinning machines in an economical manner, a second duct or channel is provided above a package creel and parallel to a first suction duct or channel. Both ducts discharge into a common suction chamber. Connecting channels conduct a portion of the air quantity sucked-up by suction nozzles into the second duct or channel. The cross-section of the second duct is enlarged, with increasing length of such duct, in a manner such that there prevails in both ducts essentially the same mean air velocity.

9 Claims, 5 Drawing Figures

METHOD FOR THE SUCTION REMOVAL OF THREAD BREAKS AND THREAD SUCTION APPARATUS

BACKGROUND OF THE INVENTION

The present invention relates to a new and improved method of, and apparatus for, removing by suction thread breaks or ruptures, especially at double-sided spinning machines.

Generally speaking, the arrangement of the present development is of the type wherein a first suction duct or channel essentially extends over the length of the spinning machine and is provided with suction nozzles. This first suction duct is located at a region beneath a drafting mechanism or arrangement and opens at its one end into a suction chamber.

Heretofore known constructions of ring spinning machines possess, at the region beneath the drafting mechanism or arrangement, as a general rule a suction duct or channel for both sides of the ring spinning machine. In long ring spinning machines this, of necessity, results in long suction ducts or channels with correspondingly high pressure losses, i.e., with a correspondingly low negative pressure at the starting region of the suction duct or channel and a too meager suction effect which results therefrom. In order to be able to nonetheless draw-in essentially the same quantity of air with each suction nozzle, it is necessary, on the one hand, to generate high negative or underpressures at the end region which, on the other hand, must be compensated by reductions in the cross-sectional area of the suction nozzles, resulting in the danger that lap formation will occur at the lowest drafting rolls or rollers. The danger of lap formation exists if, upon thread break or rupture, the fibre material delivered from the drafting mechanism cannot be properly sucked away because there prevails too low an air velocity or too small a cross-section of the suction nozzle.

Additionally, it should be appreciated high pressure losses result in high power requirements.

In German Patent Publication No. 1,265,017 there is disclosed in this technology a double-sided spinning machine, wherein there is provided at each respective side of such spinning machine a duct or channel which extends over the entire length of such machine.

In order to at least partially counteract the aforementioned problem of the high air velocity for each duct or channel there is arranged one filter-fan unit at the center of the length of the machine. This unit is arranged above a package creel constituting part of the ring spinning machine. Each filter-fan unit is connected by means of a channel with the related suction duct.

By virtue of this arrangement there exists the disadvantage that the filter-fan unit must be provided over the package creel, necessitating a relatively large overall structural height of the ring spinning machine.

SUMMARY OF THE INVENTION

Therefore, with the foregoing in mind it is a primary object of the present invention to provide a new and improved method of, and apparatus for, sucking-off thread breaks or the like in a manner not associated with the aforementioned drawbacks and limitations of the prior art proposals.

Another and more specific object of the present invention aims at attaining a uniform suction effect over the entire length of the ring spinning machine, even for relatively long ring spinning machines, without the need to appreciably increase the structural height of the machine, and while retaining a favourable mean or average air velocity and, therefore, low power requirements.

Still a further significant object of the present invention is directed to a new and improved construction of apparatus for sucking away broken threads or the like at ring spinning machines, which apparatus is relatively simple in construction and design, economical to manufacture, extremely reliable in operation, not readily subject to breakdown or malfunction, and requires a minimum of maintenance and servicing.

Now in order to implement these and still further objects of the invention, which will become more readily apparent as the description proceeds, the method aspects of the present development are manifested by the features that, a second air stream is formed essentially parallel to the first mentioned air stream and this second air stream is guided in a parallel second duct or channel. The second air stream is diverted or branched-off from the first air stream at a location where the first air stream has attained an air velocity of at most approximately 18 m/sec.

As heretofore mentioned the invention is not only concerned with the aforementioned method aspects but also pertains to apparatus for the performance thereof. As to a preferred construction of apparatus the same contains a second duct which is arranged substantially parallel to the first suction duct or channel, and there is provided at least one essentially perpendicular connecting channel between the first suction duct and the second duct.

The advantages which can be realised with the invention essentially reside in the features that, notwithstanding the presence of a long suction duct there can be maintained a small difference in the velocity of the transport air between the beginning and end of the suction duct. This, in turn, results in essentially uniform velocity conditions, and thus, pressure conditions prevailing over the entire length of the ring spinning machine.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a velocity diagram of the air in the second duct or channel;

DETAILED DESCRIPTION OF THE PREFERRED EMBODIMENTS

Figure 1:
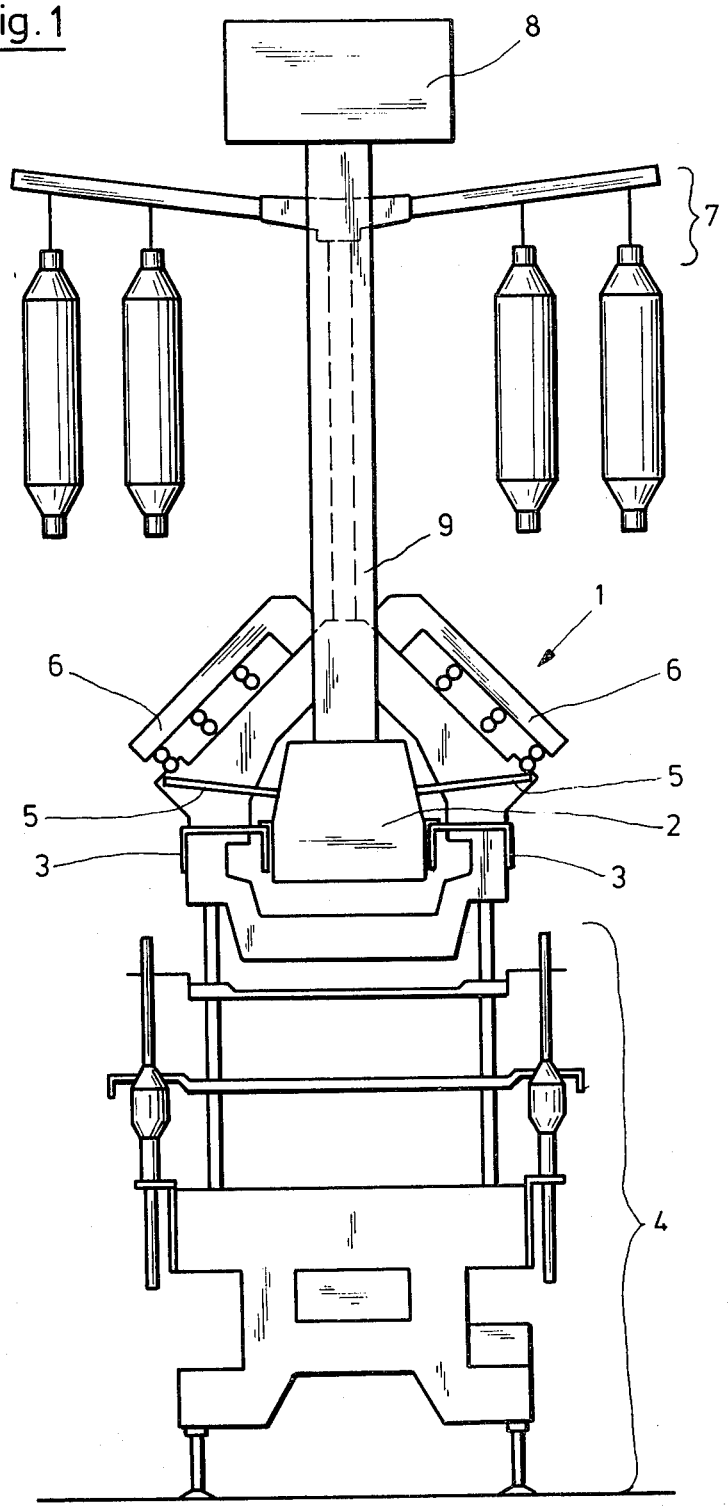
FIG. 1 is a schematic cross-sectional view through a double-sided ring spinning machine equipped with a thread suction apparatus according to the invention.

Describing now the drawings, it is to be understood that only enough of the textile machine, here specifically the ring spinning machine, with which the thread suction apparatus of the present development can be beneficially used, has been shown in the drawings as needed to enable those skilled in this art to readily understand the underlying principles and concepts of the present development, while simplifying the illustration of the drawings. Turning attention now specifically to FIG. 1, there will be seen a ring spinning machine 1 at which a first suction duct or channel 2 is supported by means of two suitable supports or mounting devices 3 upon a portion of the ring spinning machine, which for convenience in the description has been merely simply designated as the lower part or portion 4.

Connected in flow communication with the suction duct or channel 2 are suction nozzles 5, each of which leads in such close proximity to the not particularly depicted thread path at the outlet end of a related drafting mechanism or arrangement 6 that, in the presence of a thread break or rupture, the fibre material delivered by the drafting mechanism 6 is effectively sucked-off. Additionally, these suction nozzles 5 remove dust and fly by their suction action during the spinning process.

Figure 2:
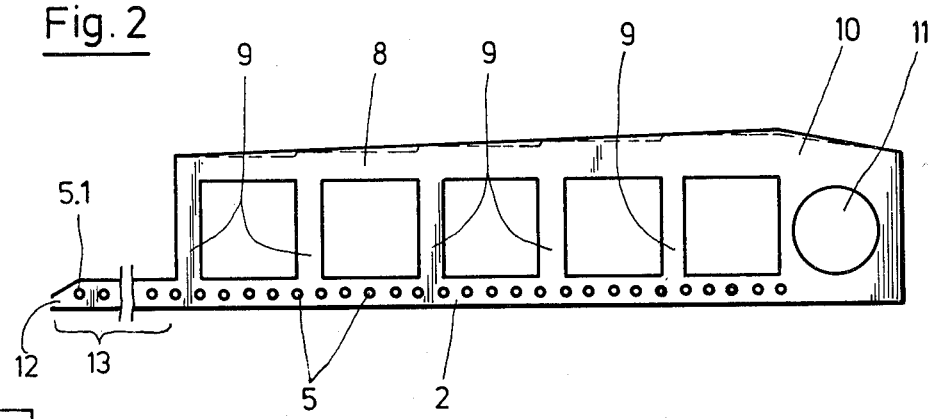
FIG. 2 is a schematic longitudinal view of the thread suction apparatus according to the invention.

Above a suitable package creel 7 there is arranged a second parallel duct or channel 8 which is flow connected with the suction duct 2 by means of essentially vertically extending or perpendicularly disposed connecting channels 9 or equivalent structure. FIG. 2 schematically illustrates the ducts or channels 2 and 8 opening into a suction chamber 10 where, for instance, there is arranged a drum filter 11 which, in turn, is operatively connected with a not particularly illustrated suction fan or ventilator.

At the starting region or portion of the first suction duct 2 there is provided a so-called false air opening 12. This false air opening 12 and the negative or underpressure prevailing in the suction duct 2 are coordinated to one another in such a manner that the air velocity prevailing at a first part or portion 13 of the suction duct 2 which merges with the false air opening 12 attains a value at the start of the operation which is in the order of 4 to 5 m/sec., so that the certainty fibre and thread materials which have been sucked-in by means of the first nozzle 5.1 can be transported.

Figure 4:
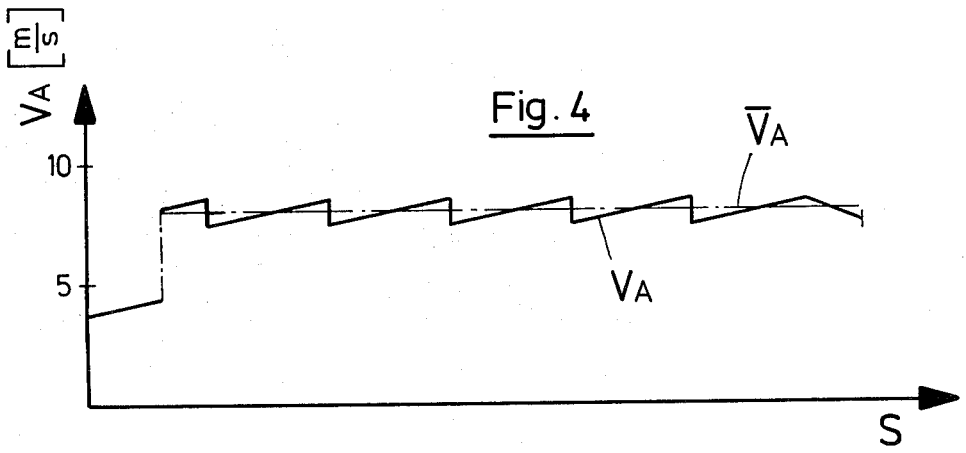
FIG. 4 is a velocity diagram of the air in the suction duct or channel.

The cross-sectional areas of the second duct 8 and the connecting channels 9 are selected such that, as represented by the dot-dash line in FIG. 4, there can be attained in the suction channel 2 a mean or average air velocity $\overline{V}_A$ of approximately 8.5 m/sec.

If, as illustrated in FIG. 2, there is selected a uniform cross-sectional area for the suction duct 2, then such results in a substantially sawtooth-shaped air velocity characteristic $V_A$ as shown in full lines in FIG. 4.

The sawtooth-shaped air velocity characteristic $V_A$ is formed, on the one hand, due to branching-off or diversion of the air into the connecting channels 9 and, on the other hand, because of the air infeed from the suction nozzles 5.

As a variant construction the cross-section for each stage, i.e., from connection channel to connection channel, can be increased proportional to the increasing air volume, so that the air velocity characteristic becomes linear, in other words, $V_A$ corresponds to $\overline{V}_A$.

Figure 3:
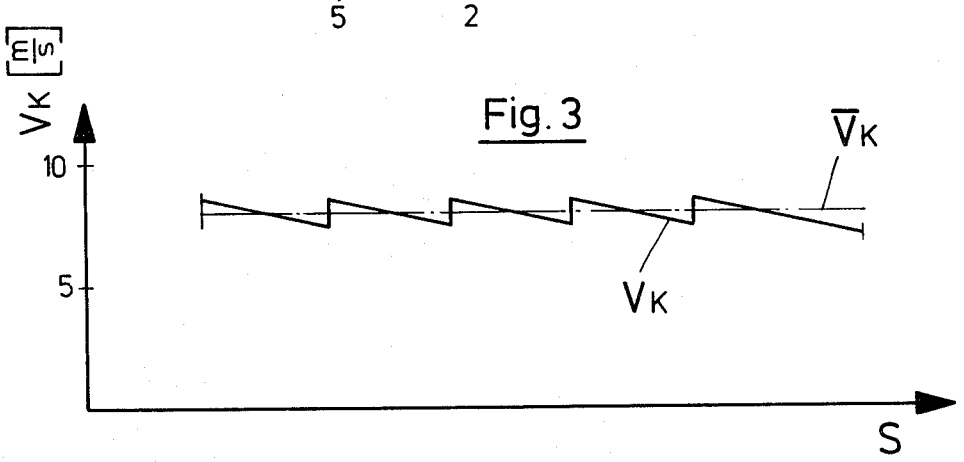

The number of suction nozzles 5 depicted in FIG. 2 constitutes a purely schematic representation. The abscissa designated by reference character S in FIGS. 3 and 4 is representative of the length of the suction ducts 2 or 8.

The cross-sectional area of the connecting channels 9 is selected such that, with an average air speed or velocity $\overline{V}_A$ of about 8.5 m/sec., the air speed or velocity in the connecting channel is approximately equal to 8 to 10 m/sec.

As a rule it is possible to therefore assume that a connecting channel should be provided each time an air velocity $V_A$ of 8 to 18 m/sec., preferably 8 to 10 m/sec., has been reached due to the total of the air volumes in the suction duct 2 which have been drawn-in by the suction nozzles 5.

The increase in the air velocity $V_A$ in the first part 13, shown in foreshortened form in FIG. 2, of the suction duct 2 is also represented in foreshortened form in the graph of FIG. 4.

In order to ensure for the transport of fibre and thread materials also at the branch-off or diversion locations, the air-velocity $V_A$ must not be less than 6 m/sec. at the region of the branch-off or diversion channels i.e. the connecting channels 9.

The cross-sectional area of the second duct or channel 8 is chosen such that, notwithstanding each discharge from a connecting channel 9 and the increase in the air volume which is associated therewith, the average air velocity $\overline{V}_K$, as shown in FIG. 3, attains a value of preferably about 8.5 m/sec. Higher values of $\overline{V}_K$, for instance 17 m/sec. are still acceptable as concerns pressure losses. Inlet velocities at the fans amount to, as a rule, up to 20 m/sec.

The sawtooth-shaped velocity characteristic $V_K$ is formed with continuous widening or enlargement of the cross-sectional area of the second duct or channel 8, as has been represented by the full or solid lines in FIG. 2.

The air volumes or quantities of air in the suction duct 2 and the suction duct 8 arrive at the common suction chamber or space 10 and, by the action of the not particularly illustrated but conventional suction fan connected after the drum filter 11, are further conveyed through such drum filter and downstream thereof depending upon the prevailing requirements.

The second duct 8 can be provided either, as shown in FIG. 2, with a continuous cross-sectional area increase or enlargement or, as has been depicted with broken lines, with a stepwise increasing cross-section area. In the last-mentioned case, the regular air velocity $V_K$ essentially corresponds to the mean air velocity $\overline{V}_K$, i.e. $V_K \cong \overline{V}_K$.

Figure 5:
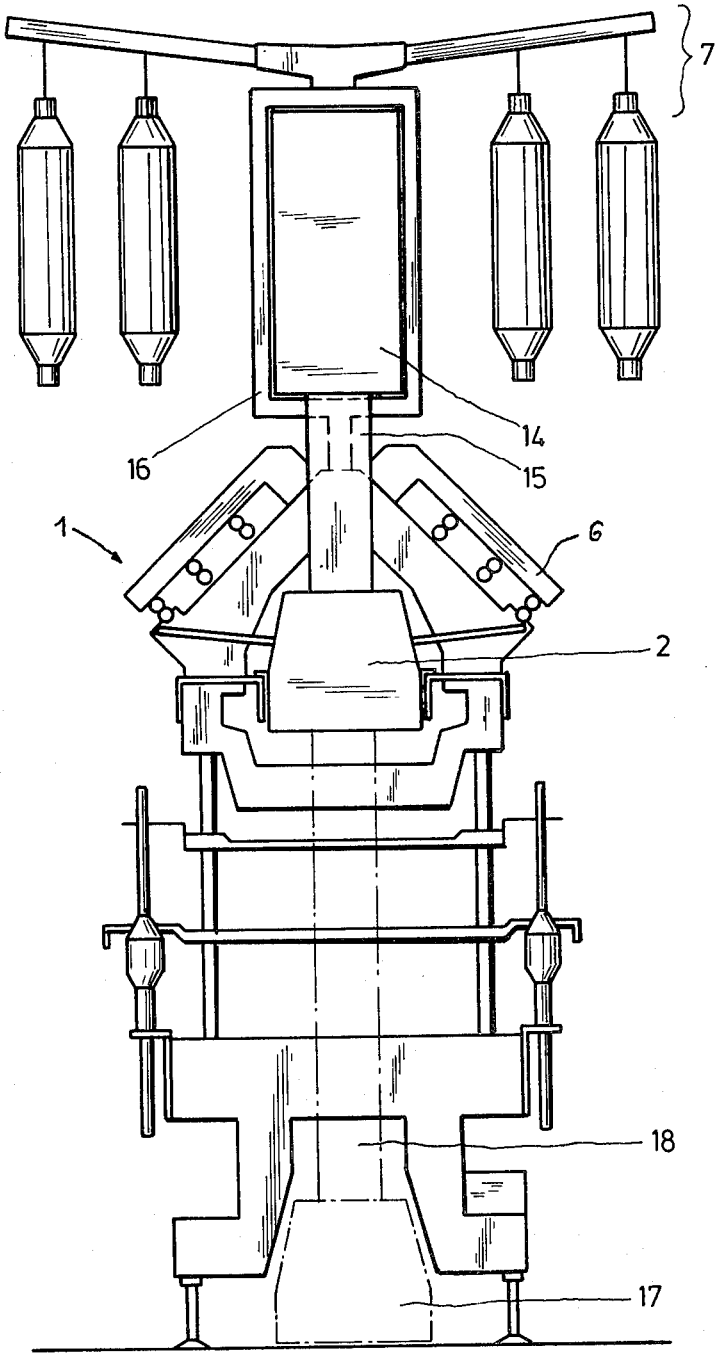
FIG. 5 is a schematic cross-sectional view through a ring spinning machine essentially of the type corresponding to the arrangement of FIG. 1, but containing respective modifications of the inventive thread suction apparatus.

Continuing, in FIG. 5 there have been depicted two possible modified constructions of the second duct or channel.

In one case the second duct or channel 14 is provided between the package creel 7 and the drafting mechanisms or arrangements 6 and is connected with the suction duct or channel 2 by means of connecting channels 15. A special support or carrier 16 is required for the package creel 7.

In the second case, depicted by phantom lines at the lower half of FIG. 5, it is proposed to accommodate a second duct or channel 17 at the lower part 4 of the ring spinning machine which, as will be evident by inspecting FIG. 5, requires certain changes in such lower part of the textile machine.

This second duct 17 is connected by means of connecting channels 18 with the suction duct 2.

With this variant construction of the invention, the second duct 17 clearly also fulfils the function of transporting the fibre and thread material.

The other elements which have not been particularly described in the arrangement of FIG. 5 generally correspond to the elements heretofore discussed in conjunction with the ring spinning maching illustrated in FIG. 1.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A method for removal by suction of thread breaks, in particularly at a double-sided ring spinning machine, comprising the steps of:

conducting a first air stream which is at a negative pressure through a suction duct provided with suction nozzles and extending over essentially the entire length of the ring spinning machine;

sucking away by means of the first air stream fibre and thread particles through the suction nozzles;

forming a second air stream in a duct which is arranged substantially parallel to the suction duct through which flows the first air stream; and branching-off the second air stream from the first air stream at a location where the first air stream has attained an air velocity of at most approximately 18 m/sec.

2. The method as defined in claim 1, further including the steps of:

diverting the second air stream from the first air stream at a location where the first air stream has attained an air speed of 8 to 10 m/sec.

3. The method as defined in claim 1, further including the steps of:

providing a mean velocity in the air stream where the fibre and thread particles must be transported which at least amounts to about 4 m/sec. and at most amounts to about 18 m/sec.

4. A thread suction apparatus, especially for a double-sided spinning machine, for sucking-off thread breaks or the like, comprising:

a first suction duct provided with suction nozzles;

said first suction duct extending over substantially the length of the machine;

said first suction duct being located at a region beneath at least one drafting mechanism and discharging to a predetermined location;

a second duct extending essentially parallel to the first suction duct; and at least one substantially vertically extending connection channel provided between the first suction duct and the second duct.

5. The thread suction apparatus as defined in claim 4, wherein:

both first and second ducts discharge to said predetermined location.

6. The thread suction apparatus as defined in claim 4, wherein:

the first suction duct possesses a cross-sectional area essentially over its entire length which is structured such that the mean air velocity does not fall below approximately 4 m/sec. and does not exceed approximately 18 m/sec.

7. The thread suction apparatus as defined in claim 6, wherein:

said connecting channel is provided at that location of the first suction duct at which the air velocity in the first suction duct has attained at most approximately 18 m/sec.

8. The thread suction apparatus as defined in claim 7, wherein:

a plurality of successive connecting channels are provided, wherein between each two successive connecting channels there is defined a stage; and said second duct possessing an increasing cross-sectional area for each progressive stage.

9. The thread suction apparatus as defined in claim 7, wherein:

a plurality of successive connecting channels are provided, wherein between each two successive connecting channels there is defined a stage; and said second duct possessing a continuously increasing cross-sectional area for each progressive stage.

* * * * *